United States Patent [19]

Stone

[11] 4,198,900

[45] Apr. 22, 1980

[54] METHOD OF MAKING A RECLOSEABLE, PILFER-PROOF CONTAINER

[76] Inventor: Orison W. Stone, R.F.D. #1, New Haven, Vt. 05472

[21] Appl. No.: 950,551

[22] Filed: Oct. 12, 1978

Related U.S. Application Data

[62] Division of Ser. No. 805,174, Jun. 9, 1977, Pat. No. 4,141,449.

[51] Int. Cl.[2] ..... B31B 1/26

[52] U.S. Cl. ..... 93/49 M; 53/462

[58] Field of Search ..... 93/36 M, 39 R, 49 M, 93/49 R, 53 M, 84 R; 53/462; 229/37 R; 206/621, 624–626, 630, 631, 634

[56] References Cited

U.S. PATENT DOCUMENTS

| | | | |
|---|---|---|---|
| 1,940,849 | 12/1933 | Davidson | 206/626 |
| 2,122,480 | 7/1938 | Lowey | 206/624 X |
| 3,219,253 | 11/1965 | Davis | 229/37 R X |
| 3,311,281 | 3/1967 | Eisman | 206/631 X |
| 3,389,850 | 6/1968 | Rockefeller | 206/45.31 X |
| 3,591,071 | 7/1971 | Rosenburg, Jr. | 206/626 |
| 3,680,767 | 8/1972 | DeLorenzo et al. | 206/621 |
| 4,062,486 | 12/1977 | Goodrich | 206/626 |

*Primary Examiner*—Robert D. Baldwin
*Assistant Examiner*—J. Reed Batten, Jr.
*Attorney, Agent, or Firm*—Wood, Herron & Evans

[57] ABSTRACT

A recloseable, pilfer-proof container is disclosed which is formed from a single blank of fiberboard according to a method of the present invention. The container includes a six-sided, closed container base portion having a hinged, pilferproof access flap. A tear-open, hinged access flap is defined in the top and front sides of the container base by a broken cut line. A pair of locking tabs are defined by the cut line in the front side of the container base adjacent the access flap. A hinged lid portion overlies the access flap and is glued to the access flap so that it is constrained to pivot with the flap. When the lid portion is grasped and pivoted to open the container for the first time, the hinged access flap is torn away from the top and front sides of the container base along the cut line and is pivoted on its hinge. When the lid portion and flap are reclosed, the locking tabs engage corresponding edges of the flap to lock the lid portion and flap in the closed position.

4 Claims, 5 Drawing Figures

METHOD OF MAKING A RECLOSEABLE, PILFER-PROOF CONTAINER

This is a division, of Application Ser. No. 805,174, filed June 9, 1977 and now U.S. Pat. No. 4,141,449 issued Feb. 27, 1979.

BACKGROUND OF THE INVENTION

The present invention relates to containers formed from foldable sheet material, and more particularly, to a pilferproof, recloseable container formed from a single paperboard blank.

Paperboard containers are used extensively in packaging a wide variety of products. Many of these products may be conveniently stored in the container after the container is initially opened. Accordingly, it is advantageous to provide a recloseable container with a locking lid or hinged cover. A container satisfying this requirement is shown, for example, in applicant's U.S. Pat. No. 3,404,829. Frequently, however, the cost of the paperboard container constitutes a significant portion of the cost of the entire packaged product. It is, therefore, advantageous to reduce the cost of the container by simplifying the steps necessary to prepare, form and glue the paperboard blank(s) and to minimize the amount of paperboard consumed in making the container. Containers such as shown in applicant's patent, above-cited, go a long way toward realizing these goals. However, these containers require a number of additional paperboard panels over and above the number necessary to form a simple, rectangular solid-shaped container.

Containers such as shown in FIG. 3 of applicant's patent, employ locking tabs projecting from two top edge flaps (26 and 28), the locking tabs being adapted for engagement with a double walled lid for locking the lid in a closed position. Such an arrangement, while having many inherent advantages including a smoothly operating locking action, requires as many as three layers of paperboard on the top and front sides of the container. Containers of this type require edge flaps (such as flaps 26 and 28) to reinforce the container base and to establish a loose fitting seal, along the edges of the lid.

Accordingly, it is an object of the present invention to provide a recloseable container employing a minimal amount of paperboard.

It is another object of the present invention to provide a recloseable container with smoothly operating locking action, which requires a minimal amount of paperboard to fabricate.

It is a further object of the present invention to provide a recloseable container with an initially sealed lid, easily fabricated from a single blank and set up and filled by most standard cartoners.

Conventional containers, such as shown in applicant's patent, require that a substantial amount of upward force be exerted on their lids to open the lids by releasing the locking tab from its mating aperture on the cover lid. This is due, in part, to the fact that the locking tab is oriented almost perpendicularly to the portion of the lid with which it mates. In addition, fabrication of such containers requires care to insure that the tabs and corresponding mating apertures are in proper registration.

Accordingly, it is another object of the present invention to provide a recloseable container with at least one locking tab, which is easily opened and which can undergo numerous closings and openings without degradation of the locking tabs.

It is yet another object of the present invention to provide a recloseable container with at least one locking tab and corresponding mating surface, which is easily fabricated to insure proper registration of the locking tab and mating surface.

Frequently, there is a need to enclose printed material such as coupons, instructions, etc. with a product packaged in a paperboard container. It is desirable that the printed material be located in a readily accessible place in the package, that it be held securely in place, and/or that it be easily seen by the purchaser.

Accordingly, it is another object of the present invention to provide a container having an easily accessible compartment for holding printed material (or a second product).

It is a further object of the present invention to provide a container for retaining printed material, in addition to the packaged product, which printed material is diplayed through an aperture in the container.

In the case of many consumer products, such as food products, it is desirable that the product be packaged in factory sealed containers. These containers are initially opened by breaking the seal. Such "pilfer-proof" packaging has the advantage that it discourages the opening of the container by unauthorized persons prior to sale thereof, and provides proof to the customer, viz. the unbroken seal, that the container has not been previously opened. Pilfer-proof containers, of a type known in the prior art are illustrated, for example, in applicant's U.S. Pat. No. 3,910,486. While the containers disclosed in this patent are advantageously used in many applications, the patented containers are flip-top containers which require additional panels of paperboard to fabricate.

Accordingly, it is another object to provide an inexpensively and easily fabricated container, employing a minimal amount of paperboard which is factory-sealed and pilfer-proof.

These and other objects and features of the present invention will become apparent from the claims and from the following description when read in conjunction with the appended drawings.

THE DRAWINGS

DETAILED DESCRIPTION

Figure 1:
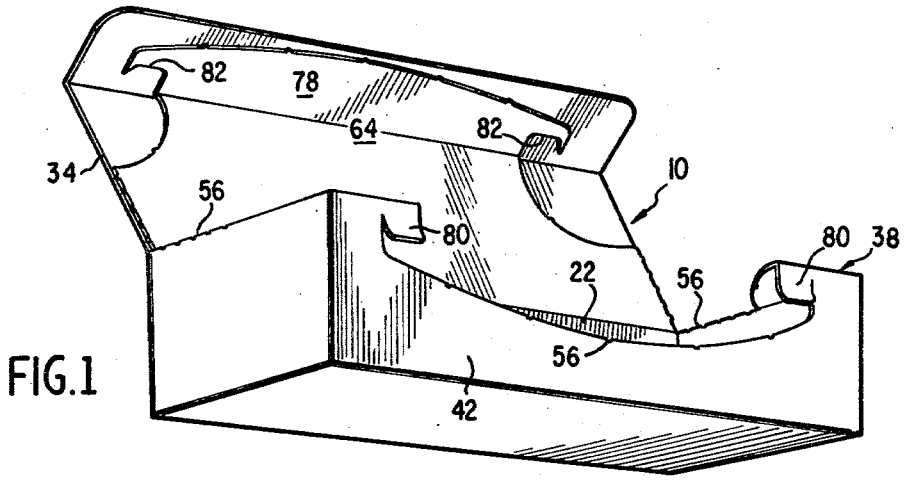
FIG. 1 is a pictorial view of a paperboard container of an embodiment of the present invention shown in an opened configuration.

Referring first to FIG. 1, a recloseable pilfer-proof container 10 is illustrated. The container of FIG. 1 is a rectangular hexahedral or 6-sided container. Advantageously, the container may be made from any type of foldable sheeting material, particularly paperboard.

The container 10 may include a hinged lid 34 and prealigned locking tabs 80 formed in a front panel 42 of the container. The locking tabs 80 may be provided to releasably engage corresponding locking edges 82 of a lid skirt 78; whereby the lid may be locked on reclosing.

In FIG. 1, the container 10 is shown with the lid 34 in its open position to expose an access opening 22. Prior to the initial opening of the container, a container access flap 64 is integrally connected to the front panel 42 and a top panel 38 of the container along a broken cut line 56 formed in panels 42 and 38; the phrase "broken cut line" being defined as a line of perforations, nicks, or an otherwise weakened linear region in the panel.

Figure 2:
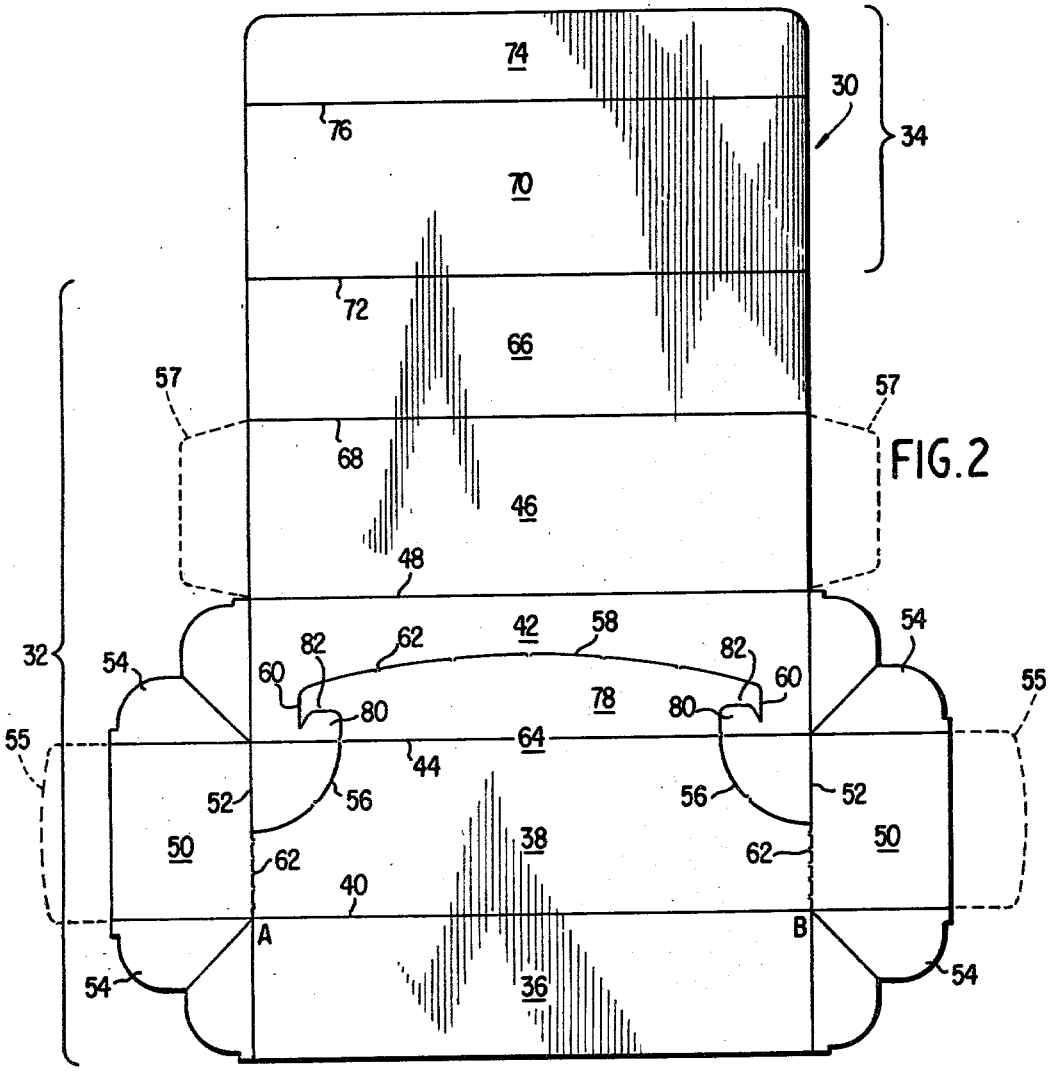
FIG. 2 is a plan view of a paperboard blank from which the embodiment of FIG. 1 may be formed.

Referring now to FIG. 2, a blank 30 for making the container of FIG. 1 is illustrated. It will be noted that the blank 30 may be formed from a single continuous piece of sheeting material. The blank 30 may include a portion 32 from which the container base is formed, the container base being defined, with respect to the embodiment of FIG. 2, as a closed hexahedral container exclusive of the lid panels collectively identified by the numeral 34. The container base portion 32 may include a rear panel 36 and a top panel 38 integrally connected to the rear panel 36 along a first score line 40. A front panel 42 may be integrally connected to the top panel 38 along a second score line 44, parallel to the first score line 40. A bottom panel 46 may be integrally connected to the front panel 42 along a third score line 48, parallel to the second score line 44. The container base may also include end panels 50 integrally connected to the top panel 38 along score lines 52. Flaps 54 may be provided integrally connected to the front and rear panels, to facilitate forming and closing the end walls of the container base. The blank may be provided with conventional final tucking flaps 55 or 57 (shown in phantom).

A broken cut line may be formed in the top and front panels of the container base, such as broken cut line 56 which describes an open curve from point A to point B on the container base. The cut line 56 may include a transverse portion 58 and generally parallel portions 60, continuous with the transverse portion 58. Advantageously, the cut line may be broken at neck portions such as those at points 62. Ends A and B of the cut line 56 may be connected by the score line 40, which, together with the broken cut line, defines a hinged container access flap or tear-away portion 64.

The container base portion may also include an outer rear panel 66 integrally connected to the bottom panel 46 along a fourth score line 68 parallel to the third score line 48. The outer rear panel 66 may be glued in face to face relationship to the rear panel 36 to facilitate forming of the container base.

The lid portion 34 of the blank may include a lid top or cover panel 70 integrally connected to the outer rear panel 66 along a fifth score line 72 parallel to the fourth score line 68. The lid portion may also include a lid skirt panel 74 integrally connected to the lid top panel 70 along a sixth score line 76 parallel to the fifth score line 72. The lid skirt panel 74 may be glued in face to face relationship to a skirt portion 78 of the hinged access flap 64.

The cut line 56 may also define locking tabs 80 located on either side of and adjacent to the flap skirt portion 78. It will be noted that when the lid skirt panel 74 is glued in face to face relationship with the flap skirt portion 78, the lid skirt panel will lie in overlying relationship to the locking tabs 80. It may also be noted that when the container is initially opened, the locking tabs 80 will be separated from corresponding, locking edges 82 of the flap skirt portion which are attached to the lid skirt panel 74. It will be readily understood that a reclosing of the container will affect locking between the locking tabs 80 and the corresponding locking edges 82. This locking action is facilitated by the fact that the locking tabs 80 and the locking edges 82 will be aligned in nearly exact registration due to the fact that they are cut from the same container panel viz. the front panel 42.

Figure 3:
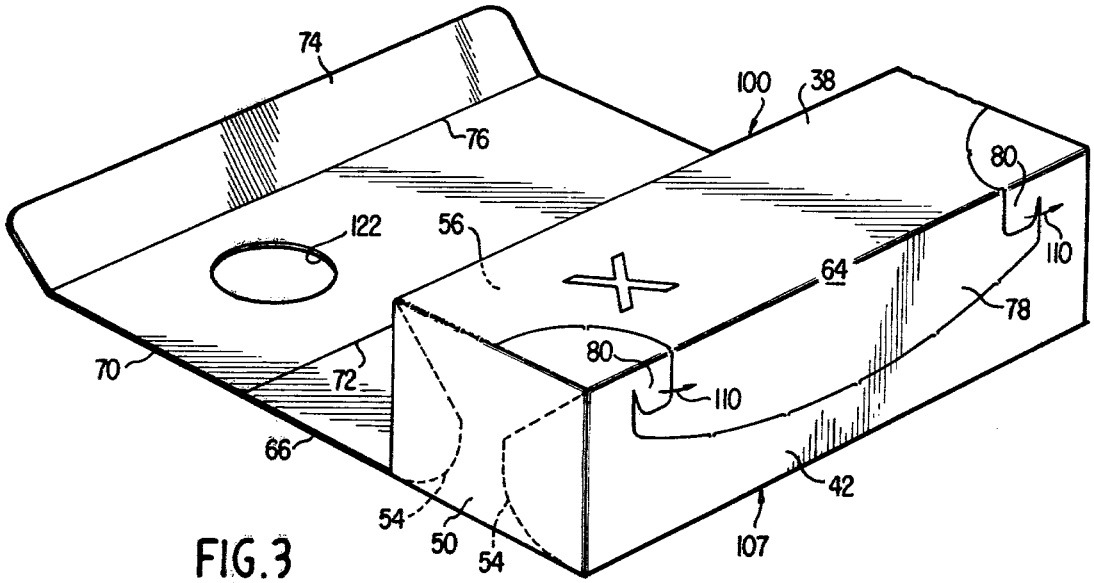
FIG. 3 is a pictorial view of a paperboard container, partially formed by folding of the blank of FIG. 2.

FIG. 3 is a pictorial view of a container embodiment 100 of the present invention, partially formed by folding of the blank of FIG. 2, wherein features of the container are identified with numbers corresponding to those in FIG. 2. The front panel 42, the top panel 38, the end panels 50, and the bottom and rear panels (not shown) have been oriented to form a closed hexahedral container base 107. The end panels 50 may be glued to the flaps 54 (see FIG. 2) to seal the ends of the container base, and the outer rear panel 66 may be glued to the rear panel 36 to completely seal the container base. The locking tabs 80 may be oriented in the figure so that the locking tabs protrude outwardly from the container base in the direction of the arrows 110 when the container is initially opened to facilitate the locking action of the lid. The lid top panel 70 may be folded along the score line 72 so that the lid top panel is disposed in generally parallel relationship to the top panel 38 of the container base. The lid skirt panel 74 may be folded along the score line 76, with respect to the lid top panel 70 so that the lid skirt panel depends downwardly from the lid top panel. The lid skirt panel may be glued in face to face relationship to the skirt portion 78 of the hinged access flap 64.

Advantageously, indicia may be printed or otherwise placed in the area of the hinged access flap denoted with an X in the figure. A corresponding aperture 122 may be formed in the lid top panel 70 through which the indicia may be viewed. Alternatively, printed material or an additional product may be inserted in a space between the top panel 38 and the lid top panel 70, the material or printed matter being frictionally engaged between the panels to retain it in place.

Figure 4:
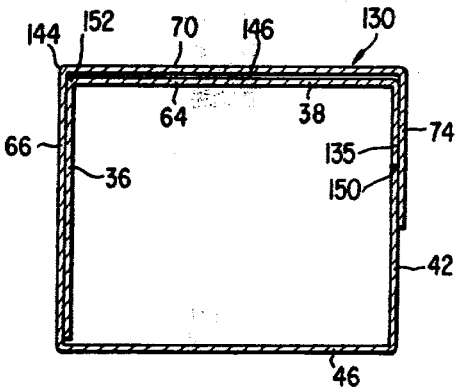
FIG. 4 is a cross-sectional view of a fully formed container embodiment of the present invention, prior to opening.

FIG. 4 is a cross-sectional view of a fully formed container embodiment 130 of the present invention, shown prior to the initial opening thereof. The container may include a rear wall panel 36 disposed perpendicularly to a top panel 38. A front panel 42 may depend downwardly from the top panel 38, and a bottom panel 46 may extend from the front panel toward the rear panel 36. An outer rear panel 66 may be glued in face to face relationship to the rear panel 36. A lid top panel 70 may be hingedly connected to the outer rear panel 66 along a score line at 72 perpendicular to the plane of the figure. The lid top panel may be disposed in parallel relationship to the top panel 38 and separated therefrom to define a space 146 into which printed material or an additional product may be placed. A lid skirt panel 74 may be glued in face to face relationship to a portion 135 of the front panel 42. A broken score line 56, formed in an open curve may, together with a hinge line at 40, perpendicular to the plane of the drawing, define a hinged access flap 64 in the container base.

Figure 5:
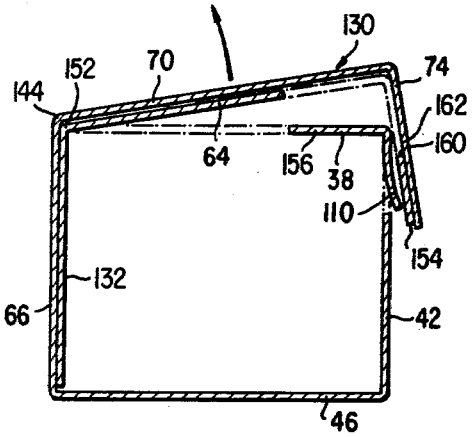
FIG. 5 is a cross-sectional view of the paperboard container of FIG. 4 after opening.

Referring now to FIG. 5, wherein like structures are identified with the numerals employed in FIG. 4, the effect of the initial opening of the container and the locking feature of the lid are described. The container 130 may be initially opened by pivoting the lid portion of the container including the lid top panel 70 about the hinge at 72. Since the lid skirt panel 74 is attached to a flap skirt portion 78 of the hinged access flap 64, the access flap may be pivoted about its hinge at 40. The pivoting of the lid panels may be operative to separate the access flap 64 from the remainder of the top and front panels 38 and 42 thereby breaking the container seal. After the initial opening of the container, the access flap and the lid portion together define a double-layered closure member for the container which is pivotable as a unit. It may be noted at this point that a portion 156 of the top panel 38 not included in the access flap may remain in position despite the pivoting of the lid portion. This remaining portion 156 of the top panel 38 may be operative to continue to hold the contents of the container within the container when the lid is opened.

With continued reference to FIG. 5, when the lid portion of the container is pivoted in the direction of the arrow, a locking tab 80 may protrude outwardly from the container. When the container is pivoted in a reverse angular direction, it will be understood that the locking tab 80 will engage a corresponding locking edge 82 of the flap skirt portion and engage an overlying portion 162 of the lid skirt panel 74. This engagement may be operative to lock the lid portion of the container in its closed position substantially as shown in FIG. 4.

The principles, preferred embodiments and modes of operation of the present invention have been described in the foregoing specification. The invention which is intended to be protected is not, however, to be construed as limited to the particular forms disclosed, since these are to be regarded as illustrative rather than restrictive. Variations and changes therefore may be made by those skilled in the art without departing from the spirit and scope of the present invention.

What is claimed is:

1. A method of forming a pilfer-proof, recloseable contaner from a single paperboard blank comprising the steps of:

providing a blank for forming a closed, six-sided container base and a lid portion;

forming at least one broken cut line on the blank to define a hinged access flap in at least two adjacent sides of the container base;

folding the blank to form the closed, six-sided container base;

attaching the lid portion to a side of the container base; folding the lid portion into a lid top panel and a lid skirt panel; and, attaching the lid skirt panel to the hinged access flap in face to face relationship so that the lid skirt panel overlies the access flap such that, when the container is initially opened, the access flap is released along the broken cut line and participates in the opening and closing movement of the lid portion.

2. The method of claim 1 further comprising the steps of:

forming the broken cut line to define a locking tab adjacent the hinged access flap; and, biasing the locking tab so that it engages a corresponding edge opposite the broken cut line when the container isreclosed.

3. The method of claim 2 wherein the locking tab is formed on an opposite side of the broken cut line from the access flap and wherein the lid portion is attached to the access flap so that the lid portion overlies the locking tab.

4. The method of claim 3 wherein the broken cut line is formed to define a pair of locking tabs, adjacent generally parallel edges of the access flap.

* * * * *